United States Patent [19]

Patterson et al.

[11] 4,012,262

[45] Mar. 15, 1977

[54] MANUFACTURE OF THERMALLY-INSULATING, REFRACTORY ARTICLES

[76] Inventors: Denis Arthur John Patterson, "The Cottage", Newbridge Green, Upton-on-Severn, Worcestershire; Thomas Albert Williams, "Fairways", Mill Lane, Blakedown, Kidderminster, Worcestershire, both of England

[22] Filed: Feb. 8, 1974

[21] Appl. No.: 440,704

[52] U.S. Cl. ..... 106/38.22; 106/38.23; 106/38.5 R; 106/213; 106/214; 249/197; 252/62; 260/38

[51] Int. Cl.[2] ..... B28B 7/36

[58] Field of Search ..... 106/38.22, 38.23, 38.27, 106/38.5 R, 38.9, 38.3, 38.35, 213, 214; 252/62; 249/197; 260/38

[56] References Cited

UNITED STATES PATENTS

| | | | |
|---|---|---|---|
| 3,123,878 | 3/1964 | Davidson | 106/38.2 |
| 3,297,296 | 1/1967 | Edstrom et al. | 106/38.9 |
| 3,460,606 | 8/1969 | Boddey | 106/38.5 R |
| 3,558,591 | 1/1971 | Yendrek et al. | 106/38.5 R |
| 3,660,121 | 5/1972 | McCarthy | 106/38.22 |
| 3,701,672 | 10/1972 | Ruff | 252/62 |

*Primary Examiner*—Lorenzo B. Hayes
*Attorney, Agent, or Firm*—Michael J. Striker

[57] ABSTRACT

A composition for use in the manufacture of thermally insulating, refractory articles, containing particulate refractory material and from 1 to 20 percent by weight of fibrous organic material, for example paper fibers and/or cardboard fibers, is made with a plastic consistency. For example, the composition is made with a consistency or apparent viscosity of at least 200,000 centipoises at 25° C. Methods of making the composition and for making articles from the composition are also described.

33 Claims, No Drawings

MANUFACTURE OF THERMALLY-INSULATING, REFRACTORY ARTICLES

This invention relates to an improved composition for the manufacture of thermally insulating, refractory articles employed in the metal casting industry, for example articles for lining the tops of ingot moulds and casting riser cavities. The invention also includes methods of making the composition and themally insulating, refractory articles made from the composition.

The use of thermally insulating, refractory linings in the tops of ingot moulds and in casting riser cavities has been known for many years. Used in the form of tiles and corner wedges, one-piece hollow hot tops, hollow cylinders, etc., they serve to delay solidification of the molten metal in the top of the ingot mould or in the riser cavity and thus reduce wastage of metal due to the effect of shrinkage and segregation during cooling and solidification.

In particular, such linings with substantially improved compositions based on the incorporation of a proportion of organic and/or inorganic fibrous material into the refractory mixture have become well-known during the past ten years. The incorporation of these fibres has served both to improve the thermal insulation properties of the linings and to improve their mechanical properties. Because most inorganic fibres are either expensive or are unacceptable by modern standards because of health hazards, their use in such mixtures is limited, and the main type of fibrous material used in practice is in the form of paper pulp or cardboard pulp, both of which are effective yet inexpensive.

The vast majority of the thermally insulating, refractory linings used in practice to-day are made from mixtures containing between 60 and 95 percent of powdered refractory material, between 1 and 20 percent of paper fibre or cardboard fibre and up to 20 percent of other constituents, for example organic or inorganic binders and sintering agents, these percentages all being by weight and relating to the finished composition or lining in its dry state when all the water or other liquid has been extracted therefrom.

Known methods of manufacturing such thermally insulating, refractory linings incorporating paper pulp fibres or cardboard pulp fibres involve the preparation, in some form of mechanical pulping equipment (for example a hydropulper) of a very liquid pulp of paper fibres or cardboard fibres and a substantial proportion of water (and/or other liquid) to which the refractory and other constituents are added to form a slurry. This slurry is then fed into moulds having the shape of the desired lining where the greater part of the water is removed from the mixture by the application of pressure and/or vacuum until the material is sufficiently firm for it to be removed from the mould for stove drying. It is then dried in a stove until substantially all of the remaining water is driven off and any curable resin in the original mixture has been cured.

The important common feature of the known methods of manufacture is the production of a complete mixture in the form of a liquid slurry for moulding which contains a substantial proportion of water and is of a pourable or flowable consistency. For example, a typical method would be to add 1 part by weight of dry paper or cardboard to 20 or more parts by weight of water and/or other liquid in a hydropulper, and, after converting this to a thin pulp, adding the refractory and other constituents to make a liquid slurry. The use of such a liquid slurry has serious disadvantages. Complicated arrangements for agitating the mixture at various stages in the production process prior to moulding are necessary in order to keep the solids:liquid ratio as consistent as possible. Otherwise, the amount of solids present in a finished tile or other article will vary from the desired amount with consequent detriment to the strength of the finished article and to its ability to resist penetration by molten metal when it is used. This applies whether the amount of slurry fed into a mould is measured by volume or by weight, as consistency is essential in either case. Even the widespread use of agitating devices does not prevent undesirable variation in the consistency of the slurry and in the subsequent performance of the finished article.

Another disadvantage of the use of liquid slurries is that complicated moulding equipment is needed to extract the liquid content and retain the solids during the moulding process. A relatively large volume of slurry has to be introduced into a mould having a substantial area of fine sieve material, so that the greater part of the liquid can be removed without excessive loss of solids. Because the removal has to be effected by rapid application of pressure and/or vacuum, the sieve areas have to be mechanically strong and the presses are consequently complicated and expensive.

A further disadvantage of the use of liquid slurries is that the particle sizes of the refractory material need to be chosen and blended with care in order to avoid hindering extraction of the liquid content during moulding. If the size of the particles is either too coarse or too fine, the strength of articles manufactured from the slurry will be adversely affected.

We have now found that it is possible to manufacture satisfactory thermally insulating, refractory articles with comparable physical properties to those of similar articles produced by the known methods described above, without the use of mixtures in the form of liquid slurries.

According to one aspect of the present invention, a composition for use in the manufacture of thermally insulating, refractory articles is of plastic consistency and contains fibrous organic material and particulate refractory material, the fibrous material constituting from 1 to 20 percent by weight of the composition. The composition would usually include one or more other constituents, for example a binder, a sintering agent, a light-weight filler and possibly inorganic fibrous material.

The composition of this invention is a stiff paste having a consistency similar to that of mortar used for brick-laying. Thus, when a heap of the composition is deposited on a flat surface, for example the floor, it merely slumps without showing any tendency to flow out over the surface.

Such a composition, which may also be described as a plastic solid, is a stable mixture that is not prone to separate out after preparation. It can readily be handled and can easily be measured by weight or by volume into amounts having a consistent solids content for moulding. Because of its low liquid content, it can easily be placed into a mould having a small number of vents for liquid extraction and it can be subjected to pressure in the simplest of presses in order to extract sufficient liquid to enable it to be firm enough to be removed from the mould for stove drying.

The fibrous organic material of the composition preferably consists of paper fibres and/or cardboard fibres.

The particulate refractory material may be any refractory material hitherto used for the manufacture of refractory linings for metal casting moulds, for example crushed fire brick having a particle size not exceeding 10 mesh (B.S.S. sieve).

The composition in accordance with the invention can be produced by any one of three different methods. In the first of these methods the composition is produced by adding dry organic fibrous material, for example paper or cardboard, to water and/or other liquid in almost any form of mechanical mixer (preferably one having moving blades or paddles), and subjecting the mixture to the mechanical agitation of the mixer until the fibrous material has broken down sufficiently to form a pulp, and then introducing the refractory material and other constituents and mixing them with the pulp to form a mixture of plastic consistency in which the fibrous material has been sufficiently broken down and intimately mixed.

In the second method, the dry organic fibrous material may be introduced into a similar suitable mechanical mixer simultaneously with the necessary amount of water and/or other liquid, refractory material and other ingredients and the entire mixture may be mixed until it has a plastic consistency and the organic fibrous material has been sufficiently broken down and intimately mixed.

In the third method, the dry organic fibrous material, together with the appropriate quantity of water and/or other liquid, is introduced into any form of conventional pulping equipment (for example a hydropulper) and mixed into a thick liquid pulp, this pulp then being transferred to another type of mixer in which the refractory material and other constituents are mixed in to form a mixture of plastic consistency.

Whichever of the three methods is used (the choice being largely dictated by manufacturing convenience and economics), the water and/or other liquid used is kept to the minimum necessary to moisten the refractory material and other constituents and yet produce a plastic solid. All three methods lend themselves to the production of thermally insulating, refractory articles of any desired mixture of organic fibrous material, refractory material and other constituents, and the selection of particular particle sizes for the refractory material and other constituents is unnecessary.

The exact amount of liquid required for the mixed composition to attain the desired plastic consistency for moulding varies with the proportion of organic fibrous material in the mixture and with the moisture-absorbing properties of the other constituents and has to be established by experiment. However, we have found that the weight of liquid required need not exceed 10 times the weight of dry organic fibrous material used in the complete mixture plus such an additional amount as is necessary to moisten the refractory material and other constituents. This last-mentioned amount of liquid for moistening the refractory and other constituents would not usually exceed one quarter of the weight of the refractory and other constituents.

For example, we have found that a thermally insulating refractory lining required to have a finished composition of 10 parts by weight of paper or cardboard fibre, 80 parts by weight of refractory material and 10 parts by weight of binding and sintering agents may be prepared by any of the three methods described above with the addition of only from 90 to 120 parts by weight of water and/or other liquid.

In general a composition in accordance with this invention has a consistency or apparent viscosity of at least 200,000 centipoises at a temperature of 25° C.

Contrary to expectations, we have found that refractory linings made from the compositions in accordance with the invention have comparable mechanical and physical properties to those of similar linings produced by the hitherto known methods using liquid slurries. The use of a composition in the form of a plastic solid, enables much simpler equipment to be used and the entire production operation becomes less exacting and requires less highly skilled operatives. Furthermore, in the finished articles, the fibres of organic material appear to have similar patterns of orientation as in the case of articles produced by the hitherto known methods employing compositions in the form of liquid slurries.

Furthermore, because the moulding composition can be handled so easily without separating out, it is possible to introduce useful variations into articles produced from the composition, which cannot be done in the case where liquid slurry compositions are used. For example, it is quite easy to make lining articles, for example tiles, consisting of two or more layers of different compositions by inserting a layer of one composition into the mould, spreading it roughly into position and then adding one or more further layers of different composition before pressing. Again, it is possible to make lining articles provided with mechanical devices for hanging them or fixing them in position in ingot moulds or other casting moulds, by inserting these devices into the stiff composition in the mould immediately before pressing. Furthermore it is possible to reinforce lining articles by inserting reinforcing material, for example steel rods, or wire mesh, into the stiff composition in the mould before pressing.

The invention will now be described in the following non-limitative Examples, in which parts are by weight.

EXAMPLE 1

A pulp was prepared by mixing 10 parts of dry newspaper with 110 parts of water in a Z-blade mixer. After 60 minutes mixing, the newspaper and water had formed a fibrous pulp, to which were added, in the mixer 85 parts of crushed firebrick having particle size not exceeding 10 mesh (B.S.S. sieve) and 5 parts of a phenol formaldehyde novolak resin as a binder. Mixing was continued for a further 20 minutes after which time the mixture had a plastic consistency. A measured quantity of this mixture was inserted in an open-topped tile forming mould, using a scoop, and was roughly spread within the mould cavity. The mould pressure plate was then fitted into the mould over the mixture and a pressure of about 50 p.s.i. was applied to express the greater part of the water and compact the mixture into the desired shape. The water was expressed through a number of fine holes in the mould side walls and also through the fine gaps between the mould pressure plate and the mould side walls. The pressed composition was then removed from the mould cavity and placed in a drying stove in which it was dried for a period of 3½ hours at a temperature of 150° C to remove the remaining water and cure the resin. The resulting tile had satisfactory insulating, refractory and mechanical properties when used as part of the insulating lining for the top of an ingot mould and its dimensional accuracy and surface finish were excellent. When the tiles making process was repeated, large numbers of tiles were produced having very consistent dimensions and mechanical properties and of very consistent weight and density.

EXAMPLE 2

A mixture consisting of 5 parts of dry, shredded paper, 65 parts of crushed firebrick (−10 mesh), 25 parts of calcined alumina, 2 parts of ball clay, 3 parts of dextrine and 60 parts of water was placed in a rotary mixer having a tumbling action and was mixed for 2½ hours after which it had acquired the plastic consistency of a stiff paste in which the paper fibres were adequately dispersed.

The mixture was then measured into a tile-forming mould and spread roughly within the mould cavity. Two suitably shaped preformed metal components were then pressed lightly into the mixture by hand before the mould pressure plate was fitted into the mould. The mixture was then pressed and stove dried in similar fashion to that described in Example 1.

The resulting tile had excellent properties as described in Example 1. The preformed metal components formed an integral part of the tile and served as sockets to which preformed metal hangers could be connected to provide a simple but effective means of suspending the tile from the ingot mould top.

EXAMPLE 3

A pulp was prepared by adding 2½ parts of dry cardboard to 45 parts of water in a hydropulper. This mixture was beaten at high speed for 10 minutes by which time it had formed a fibrous pulp. This pulp was then transferred to a Z-blade mixer where 60 parts of alumino-silicate refractory powder (−10 mesh), 30 parts of calcined alumina, 2½ parts of alumino-silicate fibres and 5 parts of phenol formaldehyde novolak resin were added. The resultant mixture was then mixed for 20 minutes after which time it had a plastic consistency.

A second pulp was then prepared by adding 20 parts of dry paper to 200 parts of water in a hydropulper and beating this at high speed for 10 minutes to form a fibrous pulp. This pulp was then transferred to a Z-blade mixer where 72 parts of crushed firebrick (−10 mesh), 5 parts of vermiculite powder and 3 parts of ball clay were added. This second mixture was then mixed for 20 minutes after which it also had a plastic consistency.

A measured quantity of the first mixture was then inserted into an open topped tile mould and was spread evenly over the lower part of the mould. A measured quantity of the second mixture was then inserted into the mould and spread evenly over the first mixture. The proportions of the two mixtures were so adjusted as to give a layer of the first mixture of approximately one third of the thickness of the layer of the second mixture.

The mould pressure plate was then fitted into the mould cavity and the contents were pressed and stove dried in similar fashion to that described in Example 1.

The resulting ingot mould tile for steelmaking had satisfactory mechanical properties and was dimensionally accurate. The pressing of the two mixtures into one integral tile form enabled a tile to be produced in which the side facing the molten steel poured into the ingot mould (the layer of first mixture) had substantially improved refractory properties and was better fitted to resist penetration by the molten steel, whilst the side away from the molten steel and backing onto the ingot mould wall (the thicker layer of second mixture) had substantially improved thermally insulating properties and greater mechanical strength.

This combination of properties resulted in an improved overall performance of the tile's function.

What is claimed is:

1. A molding composition for the manufacture of thermally insulating refractory articles, comprising a liquid, about 1 to 20 percent by weight on a dry basis of organic fibrous material and about 60 to 95 percent by weight on a dry basis of particulate refractory material, the liquid being present in an amount such that the composition is of plastic consistency and has a minimum apparent viscosity of about 200,000 centipoises at a temperature of 25° C.

2. A composition according to claim 1, including a binder.

3. A composition according to claim 1, including a sintering agent.

4. A composition according to claim 1, including a light-weight filler.

5. A composition according to claim 1, including inorganic fibrous material.

6. A composition according to claim 1, in which the fibrous organic material is selected from the group consisting of paper fibres and cardboard fibres.

7. A composition according to claim 1, in which the particle size of the particulate refractory material does not exceed 10 mesh (B.S.S. sieve).

8. A composition according to claim 1, in which the particulate refractory material includes crushed firebrick.

9. A composition according to claim 1, including a quantity of liquid the weight of which is at most equal to the sum of about 10 times the weight of the organic fibrous material in its dry state plus about one-quarter of the weight on a dry basis of the remainder of the composition.

10. A composition according to claim 9, in which the liquid includes water.

11. A composition according to claim 1, including up to about 20 percent by weight on a dry basis of at least one constituent selected from the group consisting of organic binders, inorganic binders and sintering agents.

12. A method of making thermally insulating refractory articles, comprising forming a composition which includes a liquid, about 1 to 20 percent by weight on a dry basis of organic fibrous material and about 60 to 95 percent by weight on a dry basis of particulate refractory material, the liquid being used in an amount such that the composition is of plastic consistency and has a minimum apparent viscosity of about 200,000 centipoises at a temperature of 25° C; and shaping the composition to a predetermined configuration.

13. A method according to claim 12, in which the forming step includes mixing the organic fibrous material with the liquid so as to break down the organic fibrous material and obtain a pulp, and mixing the remaining constituents of the composition into the pulp.

14. A method according to claim 13, in which the liquid includes water.

15. A method according to claim 13, in which both mixing steps are carried out in the same mixer.

16. A method according to claim 15, in which the organic fibrous material is added to the mixer in a dry state.

17. A method according to claim 13, in which the mixing steps include mechanical agitation by means of blades or paddles.

18. A method according to claim 13, in which the first mixing step is carried out in a pulper so as to obtain a thick liquid pulp, the pulp is transferred to a mixer and the second mixing step is carried out in the mixer.

19. A method according to claim 18, in which the organic fibrous material is added to the pulper in the dry state.

20. A method according to claim 12, in which the forming step includes mixing together simultaneously in a mixer all of the constituents of the composition.

21. A method according to claim 20, in which the liquid includes water.

22. A method according to claim 20, in which the organic fibrous material is added to the mixer in a dry state.

23. A method according to claim 12, in which the composition includes prior to shaping a quantity of liquid the weight of which is at most equal to the sum of about 10 times the weight of the organic fibrous material in its dry state plus about one-quarter of the weight on a dry basis of the remainder of the composition.

24. A method according to claim 25, in which the liquid includes water.

25. A method according to claim 12, in which the composition includes up to about 20 percent by weight on a dry basis of at least one constituent selected from the group consisting of organic binders, inorganic binders and sintering agents.

26. A method according to claim 12, in which the shaping step includes molding the composition.

27. A method according to claim 12, in which the shaped composition is heated so as to remove substantially all of the liquid therein.

28. A method according to claim 27, in which the composition includes a curable binder and the heating of the shaped composition serves to cure the binder.

29. A method according to claim 12, in which the composition includes at least one constituent selected from the group consisting of sintering agents, lightweight fillers and inorganic fibrous material.

30. A method according to claim 12 in which the fibrous organic material is selected from the group consisting of paper fibres and cardboard fibres.

31. A method according to claim 12, in which the particle size of the particulate refractory material does not exceed 10 mesh (B.S.S. sieve).

32. A method according to claim 12, in which the particulate refractory material includes crushed firebrick.

33. A method according to claim 12, in which the composition is shaped to the form of a lining for use in the metal-casting industry.

* * * * *